United States Patent [19]

True

[11] Patent Number: 4,683,962

[45] Date of Patent: Aug. 4, 1987

[54] SPINNER FOR USE IN CONNECTING PIPE JOINTS

[76] Inventor: Martin E. True, 2203 Looscan La., Houston, Tex. 77019

[21] Appl. No.: 539,753

[22] Filed: Oct. 6, 1983

[51] Int. Cl.[4] ..... E21B 19/16

[52] U.S. Cl. ..... 173/163; 175/195; 474/101

[58] Field of Search ..... 173/163, 164, 140; 175/162, 170, 113, 195; 474/103, 104, 133, 148, 149, 101; 166/78

[56] References Cited

U.S. PATENT DOCUMENTS

| | | | |
|---|---|---|---|
| 3,144,085 | 8/1964 | Hasha | 173/164 |
| 3,191,450 | 6/1965 | Wilson | 173/163 |
| 3,665,780 | 5/1972 | Lunenschloss | 474/133 |
| 3,892,140 | 7/1975 | Fox et al. | 175/195 |
| 3,906,820 | 9/1975 | Hauk | 173/164 |
| 4,079,640 | 3/1978 | Golden | 173/164 |

*Primary Examiner*—Donald R. Schran
*Assistant Examiner*—James L. Wolfe
*Attorney, Agent, or Firm*—Carl G. Ries

[57] ABSTRACT

A spinner for rotating a pipe, such as a spinner mandrel, including a chambered frame having aligned openings through which the pipe can be inserted, drive assembly, such as a sprocket, rotatably mounted in the chamber, endless flexible spinning member, such as a multistrand roller chain, normally slackly encircling the pipe and the drive assembly, and clutch assembly, such as an idler sprocket in engagement with the multistrand roller chain and a hydraulically actuatable piston for laterally moving the idler sprocket, for decreasing the slack sufficiently to force the endless spinning member into frictional rotational driving engagement with the pipe. The preferred embodiment comprises a kelly spinner for use on an oil rig for independently spinning the kelly in order to more safely connect and disconnect drill pipe joints with the kelly during drilling operations.

4 Claims, 8 Drawing Figures

SPINNER FOR USE IN CONNECTING PIPE JOINTS

TECHNICAL FIELD OF THE INVENTION

This invention relates to a spinner for use in connecting and disconnecting pipe joints. More particularly, this invention relates to a kelly spinner for use in connecting and disconnecting a kelly to drillpipe during well drilling operations. Still more particularly, this invention relates to a power operated kelly spinner utilizing endless flexible spinning means for gripping and rotating the spinner mandrel. In the preferred embodiment of the present invention means are provided for positively controlling the amount of tension applied to the endless flexible spinning means.

DESCRIPTION OF THE PRIOR ART

It has heretofore been proposed to use power operated pipe spinners or kelly spinners for use in the drilling of wells. One such power spinner unit is shown, for example, in Hasha U.S. Pat. No. 3,144,085 and Hasha U.S. Pat. No. 3,212,578 wherein a gear ring shimmed to a spindle stem is rotated by a power operated planetary gear engagable with the gear ring.

Weatherford/Lamb U.S., Inc. also manufactures and sells a kelly spinner, the design of which is shown, for example, on page 8782 of Volume 5 of the 1982/1983 edition of the Composite Catalog.

G. H. Foster manufactures and sells a kelly spinner, which is shown on page 3310, volume 3 of the 1982/1983 edition of the Composite Catalog. Yet another kelly spinner is manufactured and sold by Varco Oil Tools, as shown on page 8386, volume 5 of the 1982/1983 edition of the Composite Catalog.

Although the mechanical design features vary from kelly spinner to kelly spinner, the kelly spinners identified above all require a gear ring that encircles a kelly mandrel and complex gear and clutch arrangements for periodically engagement with the gear ring in order to rotate the gear ring and the swivel spinner to which it is operably connected.

BACKGROUND OF THE INVENTION

A kelly spinner of the present invention is suitably used in connection with a well drilling rig having a derrick, a drilling platform containing a power driven rotary for supporting and/or rotating a string of drill pipe extending through the rotary and into a well below the drilling platform, a swivel supported by the derrick above the drilling platform, a swivel sub rotatably mounted in the swivel and depending therefrom and a kelly depending from the swivel sub and interconnecting with the drill pipe so that drilling mud can be pumped by a mud pump to the swivel, and thence through the swivel sub and kelly to the string of drill pipe. During drilling operations the drill pipe is rotated by the rotary on the drill floor and, as the well is deepened by rotation of a drill bit attached to the bottom of the drill string, the drill pipe is progressively lowered through the rotary in order that the drill bit may be maintained in bearing contact with the bottom of the well. From time to time it is necessary to add an additional joint of drill pipe to the drill string, for example, because of the depth to which the hole has been drilled, and when this is to be done, it is normally necessary to interrupt rotary drilling operations, support the uppermost joint of the string of drill pipe in the rotary with slips, disconnect the kelly from the string of drill pipe supported by the slips, connect the kelly to a new joint of pipe and then connect the new joint of pipe to the drill pipe supported in the kelly.

The kelly spinner of the present invention is used, for example, during the kelly connecting and disconnecting operations described above.

SUMMARY OF THE INVENTION

The present invention is directed to a kelly spinner using endless flexible spinning means for connecting and disconnecting pipe joints. The kelly spinner of the present invention comprises a kelly spinner frame mountable about a spinner mandrel, power actuatable drive means mounted in the kelly spinner frame, endless flexible spinning means encircling the spinner mandrel and the drive means, clutch means for adjusting the tension on the endless flexible spinning means by an amount sufficient to cause the endless flexible spinning means to frictionally, rotatably engage the spinner mandrel so that it independently rotates the spinner mandrel in a clockwise or counterclockwise direction. Still more preferably, the clutch means includes an idler gear rotatably mounted to a slidable support, a piston pivotally mounted to the kelly spinner frame having a movable piston rod means for linking the piston rod to the slidable support and tensioning means for regulating movement of the slidable support and, hence, of the idler gear to thereby positively control the tensioning of the endless flexible spinning means.

BRIEF DESCRIPTION OF THE DRAWINGS

In the drawings:

FIG. 8 also showing the joint along line 7—7, from which the parts were removed in FIG. 7.

DESCRIPTION OF THE PREFERRED EMBODIMENT

Figure 1:
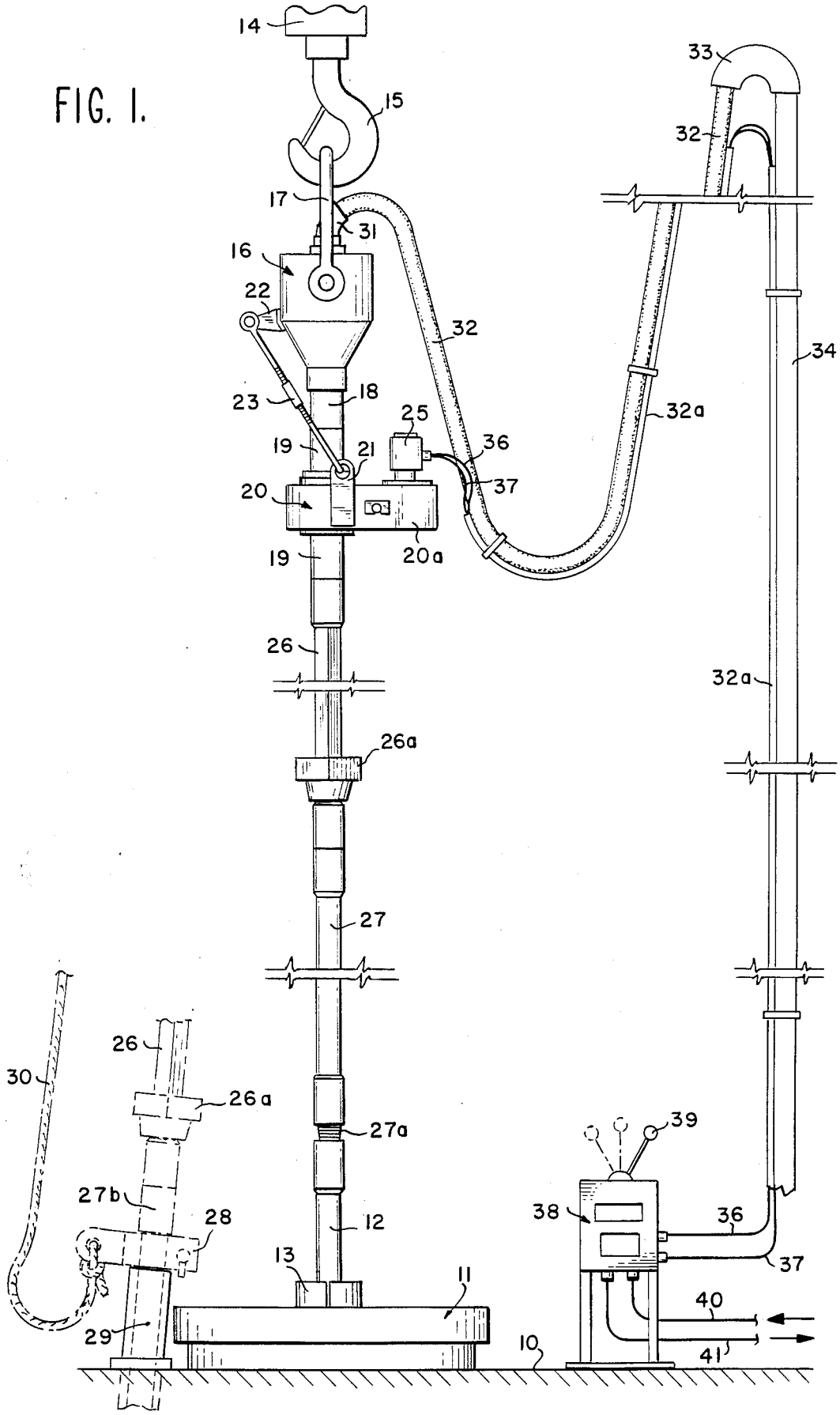
FIG. 1 is a fragmentary side elevation view of a drilling rig, with parts broken away and conventional parts not shown.

Referring now to the drawings and especially to FIG. 1, there is schematically shown a derrick floor 10 of a conventional drilling rig in which a rotary 11 is mounted. The topmost joint 12 of a string of drill pipe is shown extending through the rotary and held in place by slips 13. Although the slips 13 are shown schematically, they are preferably automatic slips of any conventional construction suitable for operation by the driller.

The drilling rig is shown schematically and fragment arily in that any conventional drilling rig may be used in the practice of the present invention. Thus, for purposes of illustration there is fragmentarily shown a travelling block 14 having a hook 15 which is suspended from a crown block of a derrick (not shown). A swivel 16 is supported by the hook 15 by means of a bale 17. A swivel sub 18 having a vertical bore therethrough is rotatably mounted on the swivel 16. The swivel sub 18 extends through and below the swivel 16 and is provided with a threaded pin (not shown) on its lower end for threaded connection to the upper threaded box end 19*a* of a spinner mandrel 19 (see FIG. 2).

Spinner mandrel 19 extends through the housing 20*a* of a kelly spinner designated generally as kelly spinner 20 and is rotatably mounted on the kelly spinner 20 in a manner to be described. The housing 20*a* is provided with a pair of pad eyes 21 which supportably attach the housing 20*a* to brackets 22 on the swivel 16 by any suitable means, such as turnbuckles 23 and prevent rotation of the housing 20*a* relative to the swivel 16.

Figure 2:
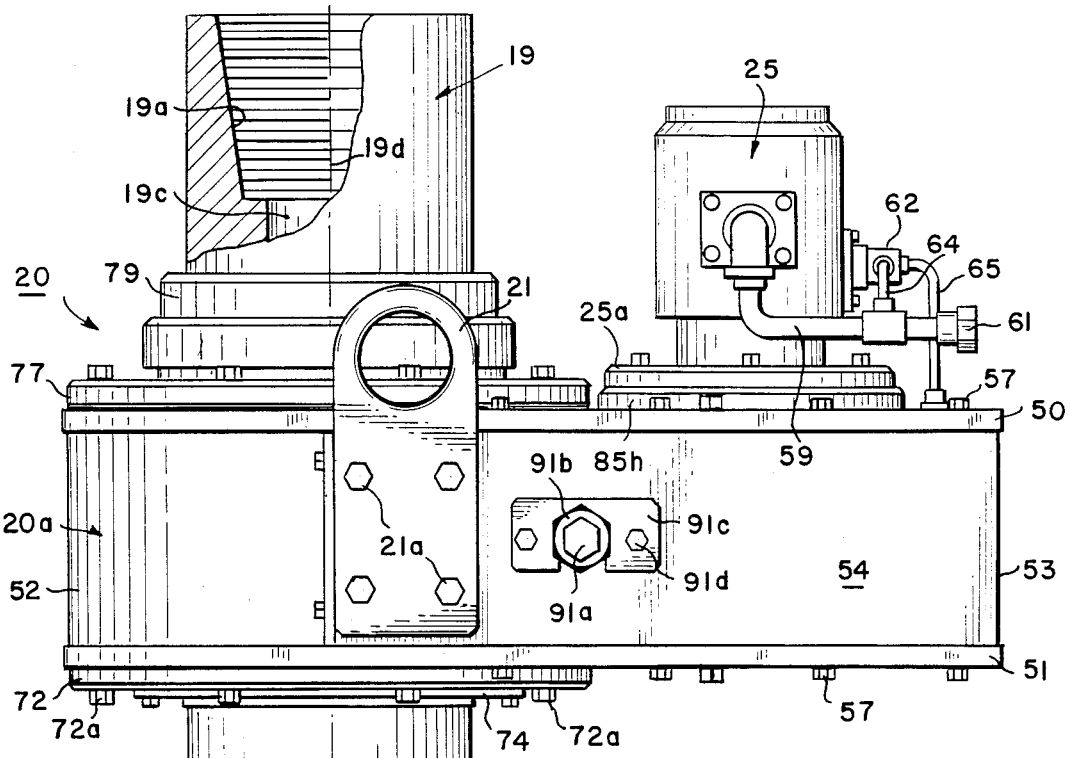
FIG. 2 is a side elevation view, to a larger scale, of the kelly spinner shown in FIG. 1.
Figure 3:
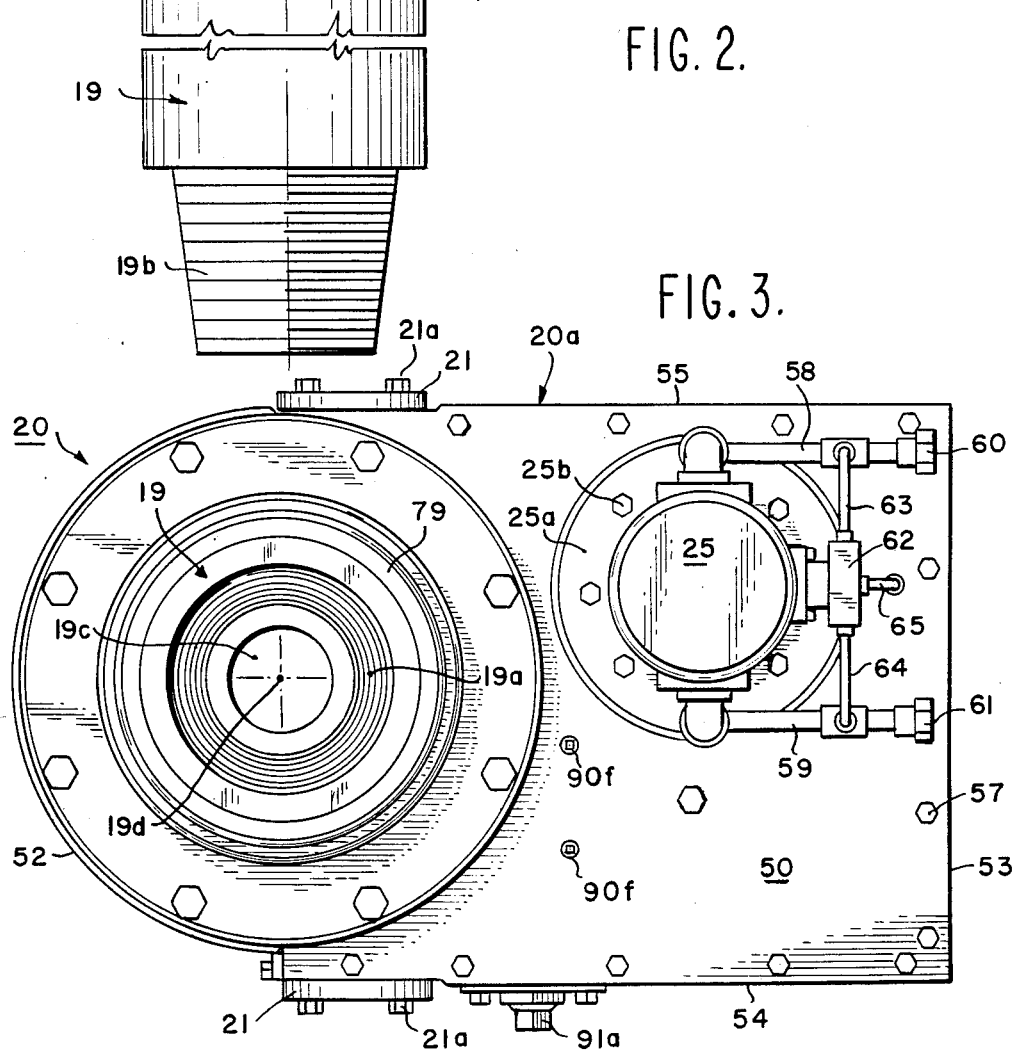
FIG. 3 is a top view of the kelly spinner shown in FIG. 2.

Referring now to FIGS. 2 and 3, a preferred embodiment of the kelly spinner 20 the present invention is shown to an enlarged scale. The housing 20*a* is comprised of a cover plate 50, a base plate 51, an arcuate front plate 52, a back plate 53, side plate 54 and side plate 55. The plates are interconnected and rigidly joined by any suitable means such as a plurality of bolts 57, thereby defining a chamber designated generally as chamber 56 (see FIG. 4). The pad eyes 21—21 are fixed to side plate 54 and side plate 55 in any suitable manner, for example, by bolts 22*a*.

The spinner mandrel 19 is rotatably mounted in the housing 20*a* in alignment with the vertical axis of the arcuate front plate 52 of the housing 20*a*, as shown more clearly in FIG. 3. The spinner mandrel 19 is provided with an upper box thread 19*a* and a lower pin thread 19*b* for interconnecting the swivel sub 18 with the upper box thread (not shown) of the kelly 26. A vertical bore 19*c* extends through the spinner mandrel 19 (See FIG. 2).

Returning now to FIG. 1, a hydraulic motor 25 of any suitable construction is mounted on the cover plate 50 of the housing 20*a* by any suitable means such as motor support plate 25*a* and bolts 25*b* (see FIG. 2). The hydraulic motor 25 may be of any suitable construction and operable with any desired hyraulic fluid such as a compressed gas (e.g. air or nitrogen) or a liquid such as a conventional hydraulic oil. Power fluid conduit 58 and conduit 59 lead from the motor 25 for interconnection with the power fluid hose 36 and power fluid hose 37 of FIG. 1. by means of connector 60 and connector 61. Valve means of any suitable construction, such as a shuttle valve 62 of the type manufactured by Commercial Shearing and Stamping Co. of Youngstown, Ohio, Model No. 25X, as shown in their Catalogue No. 100-C7 (second printing) mounted to motor 25 interconnects conduits 58 and 59 by way of branch line 63 and branch line 64. A lead line 65 connected to the center of shuttle valve 62 extends through the cover plate 50 of the housing 20*a* and connects into the power fluid end of a diaphragm piston 103 mounted in the chamber 56 of the housing 20*a* in a manner to be described and for a purpose to be hereinafter set forth.

Figure 4:
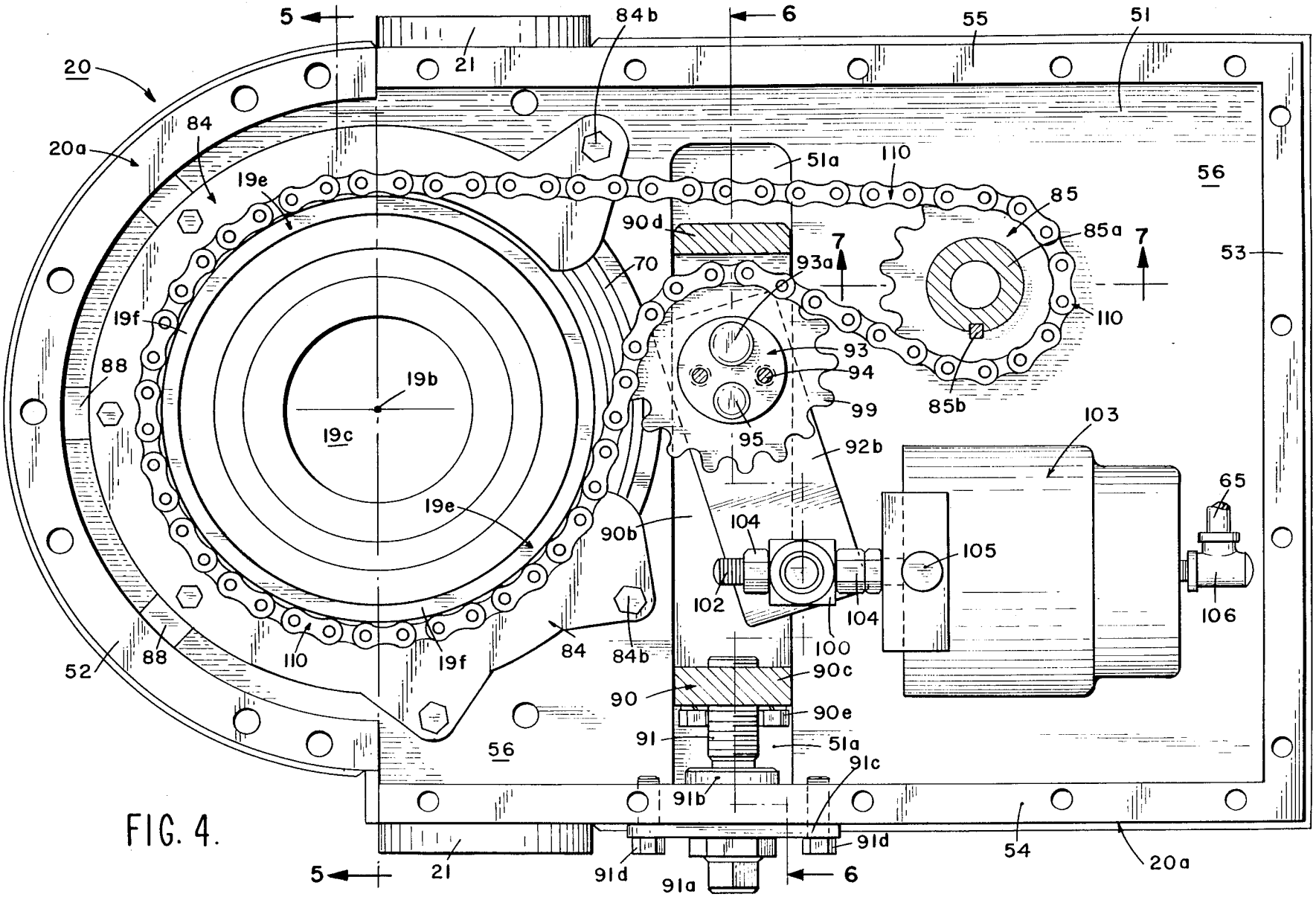
FIG. 4 is a top view, with parts broken away, of the kelly spinner shown in FIG. 3.
Figure 5:
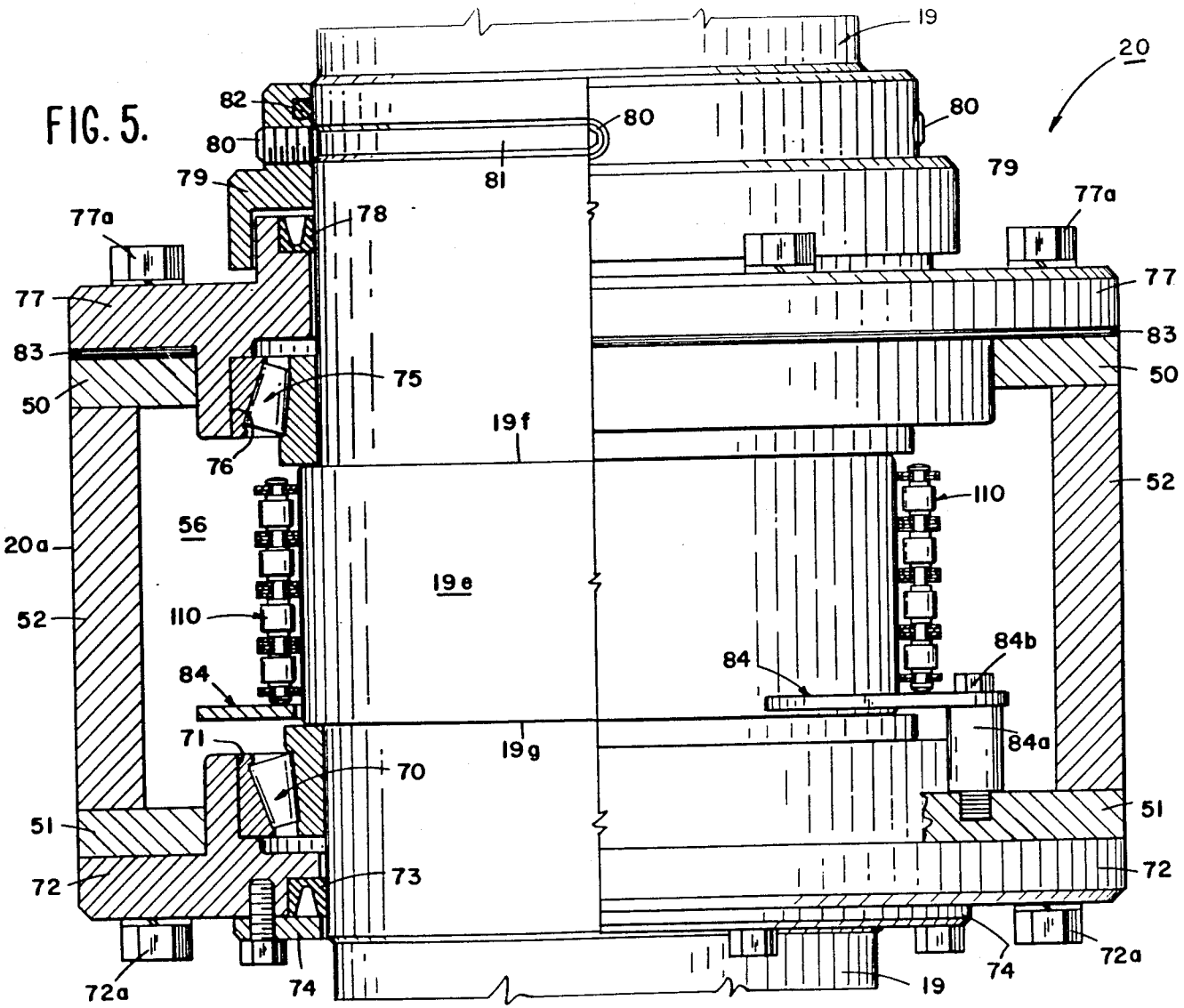
FIG. 5 is a sectional view along the line 5—5 of FIG. 4 with parts broken away.

Referring next to FIGS. 4 and 5, it will be noted that the spinner mandrel 19 is provided with a shoulder 19*e* of enlarged outer diameter forming an upper annular lip 19*f* and a lower annular lip 19*g*. The lower annular lip 19*g* supportably engages a thrust bearing assembly designated generally as lower thrust bearing assembly 70 which is in turn supported in an annular recess 71 of a lower circular bearing plate 72 which extends through the base plate 51 of housing 20*a* and is connected thereto by any suitable means such as bolts 72*a*. Plate 72 is also provided with an annular seal ring 73 held in position by any appropriate means such as bolted annular plate 74. In similar manner, a thrust bearing assembly designated generally as upper thrust bearing assembly 75 supportably engages the upper annular lip 19*f* and is contained in an annular recess 76 of upper circular bearing plate 77 which extends through the cover plate 50 and is appropriately secured thereto (e.g. by means of bolts 77*a*). Plate 77 also contains a seal ring 78. An apron ring 79 is positioned about the upper end of the plate 77 and is connected to the mandrel 19 by set screws 80 which engage an annular recess 81 in the outer wall of the spinner mandrel 19. An O ring 82 is contained in an annular recess in the apron ring 79. Shims 83 are provided between the outer flange portion of the plate 77 and the cover plate 50 for adjusting the preloading of the thrust bearings 70 and 75 relative to the spinner mandrel 19.

The accumulation of sand, dust, water or other foreign substances in the chamber of a kelly spinner tend to shorten its useful life and can cause malfunctioning or failure of the kelly spinner, particularly where the kelly spinner mechanism is based on the use of complex gear mechanisms, such as those involving the use of planetary gears. The kelly spinner of the present invention is less prone to breakdown or malfunction due to the presence of foreign substances in the chamber 56, but, naturally, such foreign substances will tend to shorten the useful life of the kelly spinners of the present invention. The various seals shown in FIG. 5 of the drawings are provided to inhibit the entry of foreign substances such as drilling mud, sand, dust, etc. from entering the chamber 56 of the spinner housing 20*a* through the openings around the spinner mandrel 19.

Also shown in FIGS. 4 and 5 is an idle chain support plate 84 that annularly partly encircles the spinner mandrel 19 just above the uppermost portion of the lower thrust bearing assembly 70. The idle chain support plate 84 is maintained in position by posts 84*a* secured to the top of base plate 51 by bolts 84*b* and brackets 88 extending from the inner surface of the front wall 52 and bolted to the support plate 84.

Figure 8:
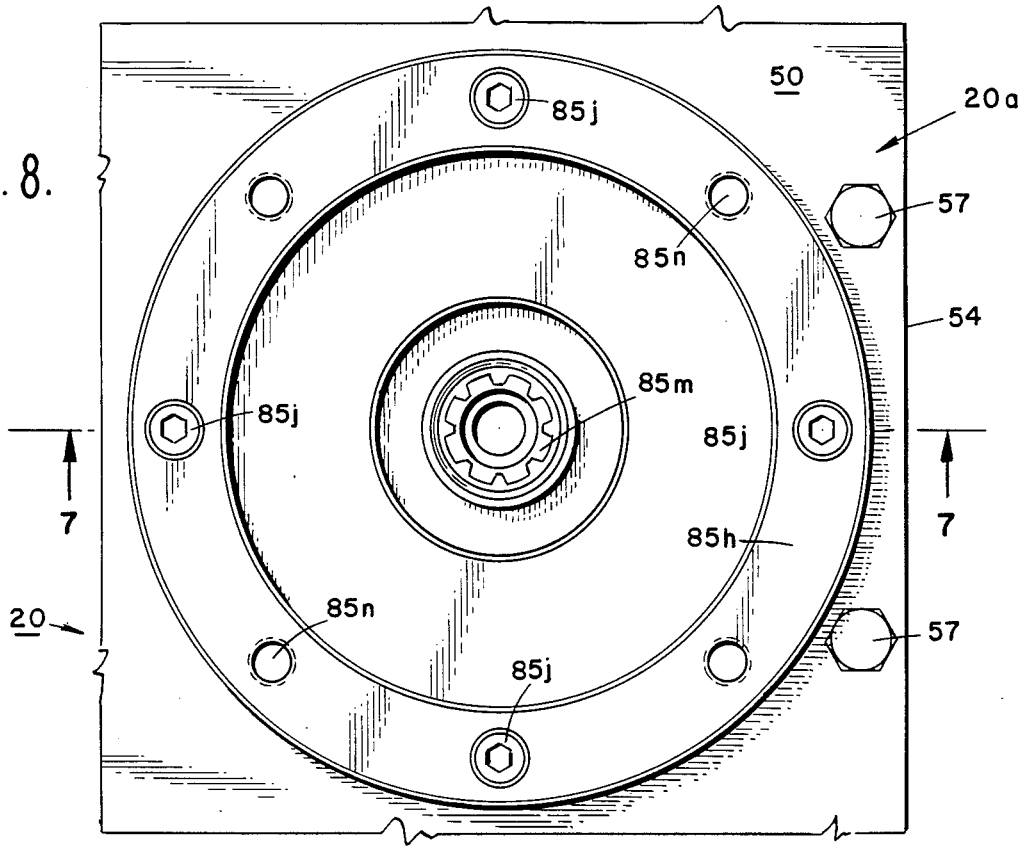
FIG. 8 is a fragmentary cross-sectional view taken along the line 8—8 of FIG. 7.
Figure 7:
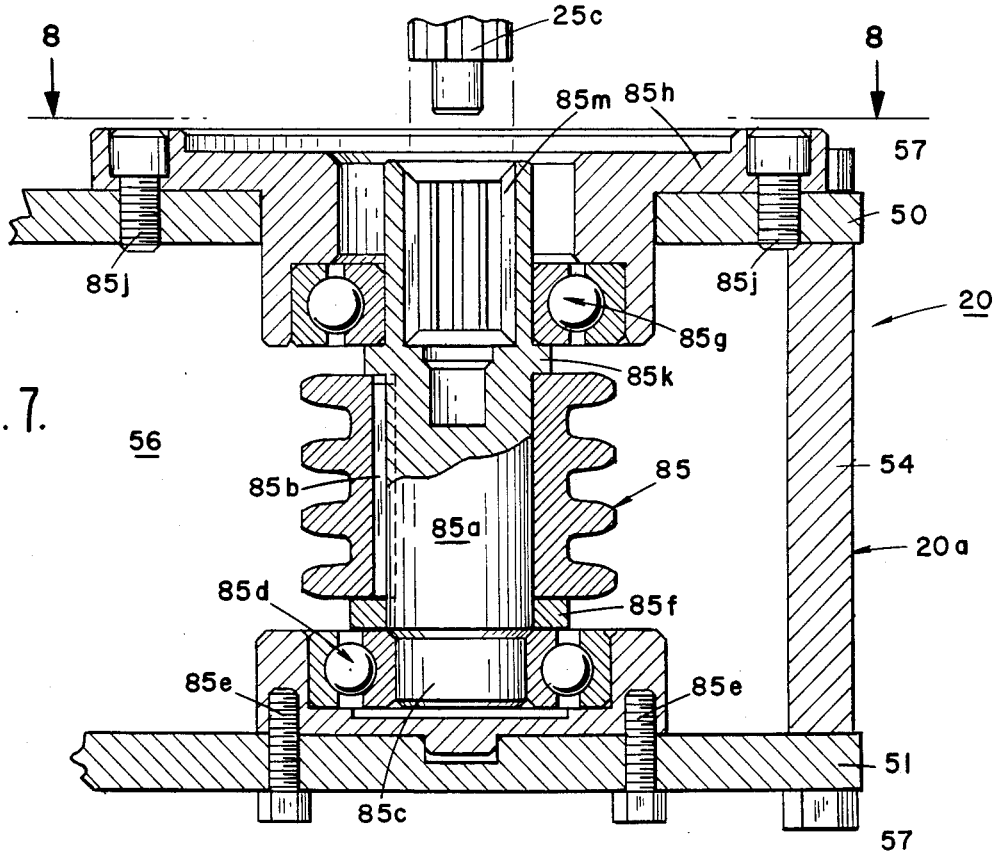
FIG. 7 is a fragmentary top plan view with parts removed of the kelly spinner shown in FIG. 3.

In FIGS. 4, 7 and 8 the construction of the drive assembly associated with the spinner drive motor 25 is shown in greater detail. A chain drive sprocket 85 is secured to a drive shaft 85*a* by a key 86*b*. The lower end 85*c* of drive shaft 85*a* is journaled in a lower bearing unit such as lower ball bearing unit 85*d* which is, in turn, positioned on the base plate 51 and secured thereto by any suitable means such as bolts 85*e*. The drive sprocket 85 is spaced above the lower ball bearing unit 85*d* by a washer 85*f*. The upper end of the sprocket shaft 85*a* is journaled in an upper bearing unit such as upper ball bearing unit 85*g* and is provided with an upper flanged section 85*h* that extends through the cover plate 50 of the housing 20*a* and is appropriately attached thereto (e.g. by bolts 85*j*). The drive sprocket 85 is spaced from the upper ball bearing unit 85*g* by annular shoulder 85*k* of shaft 85*a*. A flexible endless drive means such as "v" belts, cables, etc. or, as shown in the preferred embodiment of the present invention in the drawings (e.g. FIG. 4) a multistrand roller chain 110 is employed. The multistrand roller chain 110 is normally loosely elliptically looped about the drive sprocket 85 and the shoulder 19*e* of spinner mandrel 19.

As is shown more clearly in FIGS. 7 and 8, the upper portion of the drive shaft 85*a* is provided with a splined recess 85*m* for receiving a correspondingly splined drive shaft 25*c* of the drive motor 25. In this particular construction and as shown in FIG. 8, the flanged portion 85*h* of drive shaft 85*a* and the cover plate 50 are provided with aligned threaded bolt holes 85*n* through which bolts 25*b* are threaded in order to secure the motor support plate 25*a* of the drive motor 25 to the cover plate 50 (See also FIG. 2).

Figure 6:
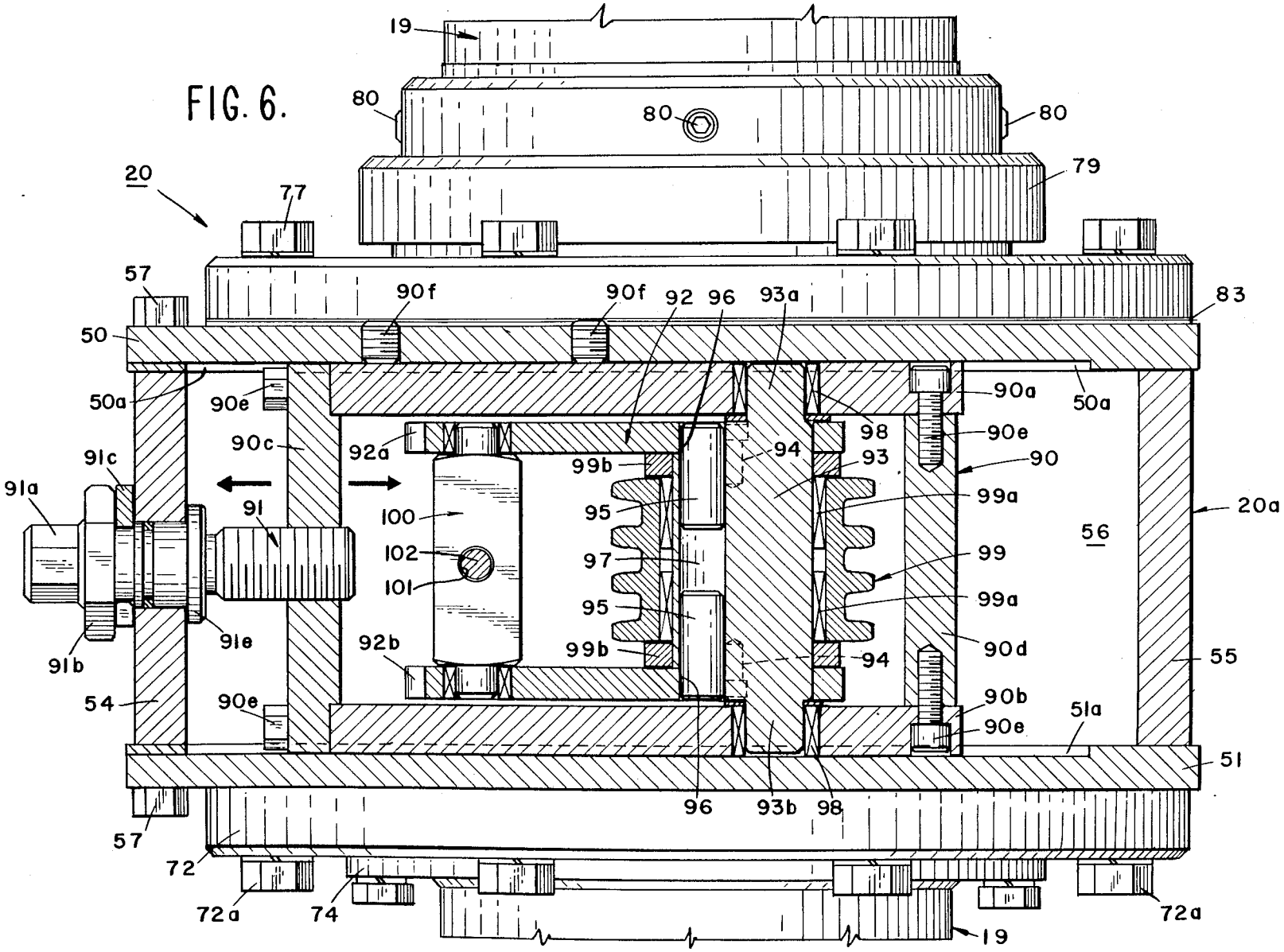
FIG. 6 is a sectional view along the line 6—6 of FIG. 4, with parts broken away.

Turning again to FIGS. 4 and 6, a slide frame assembly generally designated as slide frame assembly 90 is slidably mounted in slot 50*a* of cover plate 50 and matching vertically aligned slot 51*a* of base plate 51. The slots 50*a*–51*a* are milled transversely of the side plate 54 and the side plate 55. The slide frame 90, in this embodiment, comprises a top plate 90*a* and a bottom plate 90*b* which are appropriately interconnected at the ends thereof by end plates 90*c* and 90*d* (e.g. by means of bolts 90*e*). The positioning of the slide frame 90 in slots 50*a*–51*a* is regulated by a positioning bolt 91 which is rotatably mounted in side plate 54 and threaded through the end plate 90*c*. The positioning bolt 91 is provided a wrench head 91*a*, a hex nut 91*b* and a flat open bottomed plate member 91*c* which is appropriately fixed to the side plate 54 by any suitable means such as bolts 91*d* (see FIG. 4). The positioning bolt 91 is also provided with an annular flange 91*e* that abuts the inner side of the side plate 54 to prevent accidental rotation. In order to additionally insure against unwanted movement of the slide frame assembly 90 in the slots 50*a*–51*a*, a pair of set screws 90*f* are threaded through the cover plate 50 to engage the top plate 90*a*.

A lever arm assembly generally designated as lever arm assembly 92 comprises upper lever arm 92*a* and lower lever arm 92*b* which are vertically aligned. Each of the lever arms 92*a* and 92*b* is attached to a hub member 93 of circular cross-section by a pair of bolts 94 and a dowel pin 95*a* which is driven through each bore 96 of the upper lever arm 92*a* and the lower lever arm 92*b* and into aligned bore 97 in the hub member 93. Hub member 93 is pivotally mounted to the top plate 90*a* and the bottom plate 90*b* by vertically aligned pivot pin 93*a* and pivot pin 93*b* that are each mounted in a bearing 98 journeled in the plates 90*a*–90*b*. It is to be noted that the pivot pins 93*a*–93*b* are offset from the vertical central axis of the hub member 93.

An idler sprocket 99 is rotatably mounted about the hub member 93 in bearings 99*a* and is in peripheral engagement with the multistrand roller chain 110. Spaced washers 99*b* center the idler sprocket 99 between the upper lever arm 92*a* and the lower lever arm 92*b*. Pivotally attached to the free ends of the lever arms 92*a*–92*b* is a pivot block 100 provided with a central opening 101. A threaded piston rod 102 fixed to the diaphragm (not shown) in the diaphragm piston 103 extends through the housing of the diaphragm piston 103 and through the opening 101 in pivot block 100. The threaded piston rod 102 is provided with lock nuts 104 whereby the position of the pivot block 100 with respect to the diaphragm piston 103 may by adjusted, as desired. The housing of the diaphragm piston 103 is pivotally mounted to and between the cover plate 50 and the base plate 51 of the spinner housing 20*a* by a pair of aligned pivot pins 105, (Only one of the pins 105 is shown in FIG. 4 of the drawings).

Diaphram piston 103 is of the type shown in Bendix Rotochamber Catalogue No. 402-K-1 (i.e. of the type wherein the diaphragm of the diaphragm piston is power extended-spring retracted). It will be understood that diaphragm piston 103, which comprises the piston means in the preferred embodiment of the kelly spinner 20 of the present invention, is illustrative of the piston means that may be used and that other types of pistons such as hydraulic pistons, etc, may be used when desired. Power fluid to the diaphragm piston 103 is supplied through connection 106 connected to the lead line 65 which is in turn connected to the outlet of the shuttle valve 62 (FIG. 3). The piston rod 102 is extended when pressure is supplied to the diaphragm piston 103 and retracted when the pressure is released.

From the foregoing description, it will be apparent that the kelly spinner 20 of the present invention includes endless flexible spinning means as illustrated by the lower thrust bearing assembly 70, the upper thrust bearing assembly 75 and the multistrand roller chain 110. In like fashion, drive means for the kelly spinner 20 is illustrated by the hydraulic motor 25, the drive sprocket 85, the drive shaft 85*a* and the power means by which the hydraulic motor 25 is driven. The power means is illustrated by the power fluid hose 36, the power fluid hose 37, the conduit 40 and the conduit 41 which are hydraulically linked with the hydraulic motor 25 by connector 60 and connector 61.

The tensioning means of the present invention is illustrated by the slide frame assembly 90, the lever arm assembly 92, the hub member 93, the pivot block 100, the piston rod 102 and the diaphragm piston 103. The adjusting means is illustrated by the positioning bolt 91 and parts 91*a* and 91*b*. The slide means is illustrated by the slide frame assembly 90 and the lever arm means is illustrated by the lever arm assembly 92.

Also by way of illustration, the clutch means of the present invention includes the slide frame assembly 90, the lever arm assembly 92, the hub member 93, the idler sprocket 99, the pivot block 100, the piston rod 102 and the diaphragm piston 103. The hydraulic control means comprises power fluid hose 36, power fluid hose 37, control panel 38, control knob 39, and shuttle valve 62.

Illustrative of the support means of the present invention are the housing 20*a*, the pad eyes 21, the brackets 22, the turnbuckles 23, the boss 19*e*, the lower thrust bearing assembly 70 and the upper thrust bearing assembly 75. The sealing means of the present invention is illustrated by the upper sealing means which includes the circular bearing plate 77, the seal ring 78, the apron ring 79 and the O ring 82 and also by the lower sealing means which includes lower circular plate 72, annular seal ring 73 and annular plate 74.

It will thus be apparent to those skilled in the art that the preferred embodiment of the kelly spinner of the present invention which is shown in the drawings and which is described herein is but one of the many embodiments that can be constructed in order to provide an improved kelly spinner comprising suitable endless flexible spinning means, drive means, clutch means and associated parts such a housing, bearings, pistons, seals, fasteners, etc.

INSTALLATION OF THE PREFERRED EMBODIMENT

When the kelly spinner 20 of the present invention is to be used in well drilling operations such as in the drilling of an oil or gas well, it is necessary to transport the kelly spinner 20 to the drill site and to install it for use in connection with other equipment on the drilling rig such as the swivel, the kelly, etc.

With reference to FIG. 1, this can be accomplished with comparative ease by lowering the travelling block 14 from which a swivel 16 is suspended adjacent the floor 10 of the derrick by means of a hook 15. The two turnbuckles 23 are connected to the two brackets 22 and the two pad eyes 21 and adjusted so as to prevent rotation of the housing 20*a*. The hydraulic motor 25 may then be connected with a suitable source of power which may be, for example, hydraulic fluid. All that is necessary is to connect the power fluid lines 36 and 37 at the end of the hose bundle 32*a* with the conduits 58 and 59 of the hydraulic motor 25 by means of the connectors 60 and 61. The spinner mandrel 19 can then be connected to the swivel sub 18 by stabbing pin thread (not shown) of the swivel sub 18 into the box thread 19*a* of the spinner mandrel 19 and placing the control nob 39 on the control panel 38 into the forward position. Hydraulic fluid will flow, for example, into the conduit 58, the branch line 63 leading to the shuttle valve 62 and thence to the diaphragm piston 103 through the conduit 65 (FIG. 3). This will extend the piston rod 102 and the diaphragm piston 103 will pivot around pivot pins 105. The upper and lower lever arms 92*a* and 92*b* will pivot about pivot block 100. This will cause the hub member 93 to pivot on pivot pins 93*a* and 93*b* (FIG. 6) to urge the idler sprocket 99 toward the side plate 55. As a consequence, the multistrand roller chain 110 is brought into bearing engagement with the shoulder 19*e* and causes the spinner mandrel 19 to rotate thereby threading the spinner mandrel 19 to the swivel sub 18.

After the spinner mandrel 19 has been threaded to the swivel sub 16, the control nob 39 is moved to neutral and the piston rod 102 (FIG. 4) retracts and moves the idler sprocket 99 in the direction of the side plate 54 to thereby reduce tension on the multistrand roller chain 110, whereby the shoulder 19*e* will no longer be firmly gripped by the multistrand roller chain 110 and will no longer be rotated (even when the drive shaft 25*c* continues to be powered by control knob 39 is then moved to the neutral position to cause the kelly spinner 20 to idle and tongs, (not shown) are used to secure the joint.

Conventional drilling operations can then proceed by removing the slips 13 and lowering the drill string until the kelly bushing 26*a* is operably connected into the rotary 11. The rotary 11 is then energized and drilling mud or other well drilling fluid is supplied to the drill string by way of the swivel gooseneck 31, mud hose 32, standpipe gooseneck 33 and standpipe 34, which is connected to mud pumps (not shown). The resultant drilling operation will deepen the well. The drill string is lowered into the well by the hook 14, as the kelly 26 slides through the kelly bushing 26*a*, until the upper collar of the kelly 26 is adjacent the kelly bushing 26*a*. The rotary 11 is then stopped and the drill string is raised until until the upper portion of the drill pipe joint 27 is in the position in which the topmost joint 12 is shown in FIG. 1.

Meanwhile, pickup clevis 28, shown in dashed lines in FIG. 1, will have been been attached to a new drill pipe joint 27*a*, and hoisted by cat line 30 onto the derrick and placed in mouse hole pipe 29 supported on and extending through the derrick floor 10.

The slips 13 are brought into engagement to support the drill string from the rotary and to hold drill pipe joint 27 in position. After using tongs, if needed, to break the drill pipe joint 27 from the kelly 26, the control knob 39 on the control panel 38 is moved to the reverse position. Hydraulic fluid will flow into the conduit 58, the branch line 63 leading to the diaphragm piston 103 and the conduit 65 leading to the shuttle valve 62. This will again extend the piston rod 102 in the manner described above to thereby bring the multistrand roller chain 110 into bearing engagement with the shoulder 19*e*, but now the direction of rotation of the spinner mandrel 19 will be reversed and the kelly 26 will be unthreaded from the drill pipe joint 27. The kelly 26 can than be moved into a position adjacent the mouse hole pipe 29 so that the pin thread of the kelly 26 can be stabbed into the upper box thread of the new drill pipe joint 27*b*. The operation described above in connection with drill pipe joint 27 can then be repeated.

It will be understood that the foregoing description is a description of a preferred embodiment of the present invention, that the present invention is susceptible of many modifications from those specifically illustrated in respect of the preferred embodiment and that the scope of the present invention is defined by the claims appended hereto.

I claim:

1. A jawless kelly spinner comprising:

(a) a frame defining a chamber, said frame having vertically aligned openings therein;

(b) a spinner mandrel extending through said openings;

(c) fluidly powered drive means in said chamber rotatably mounted to said frame, said drive means comprising a hydraulically powered motor;

(d) endless flexible spinning means comprising a multistrand roller chain in said chamber in engagement with said drive means for normally slackly completely circling said drive means and said spinner mandrel whereby said spinner mandrel can rotate independently of said endless flexible spinning means;

(e) hydraulically powered clutch means in said chamber including an idler sprocket in engagement with said multistrand roller chain and tensioning means for moving said idler sprocket laterally in respect of the normal path of travel of said multistrand roller chain to decrease the slack in said multistrand roller chain sufficiently to force the inner surface of said multistrand roller chain into frictional driving engagement with said spinner mandrel to rotate said flexible driving means in a predetermined direction and to thereby spin said spinner mandrel in said direction, (f) hydraulic control means hydraulically interconnected with said rotatable drive means and said clutch means for energizing said motor, actuating said hydraulically powered clutch means and controlling the direction of rotation of said drive means, and (g) adjusting means mounted on said frame and engageable with said tensioning means for regulating the lateral movement of said idler sprocket.

2. A jawless kelly spinner comprising:

(a) a spinner mandrel having an upper box threaded end for threaded engagement with a swivel, a lower pin threaded end for threaded engagement with a kelly and an intermediate shoulder;

(b) an upper bearing mounted on said spinner mandrel in engagement with the upper edge of said shoulder;

(c) a lower bearing mounted on said spinner mandrel in engagement with the lower edge of said shoulder;

(d) a chambered frame mounted on said bearings;

(e) a fluidly powered motor mounted on said frame;

(f) a drive sprocket in said chamber rotatably mounted to said frame and mechanically coupled to said motor;

(g) an endless multistrand roller chain mounted in said chamber and normally slackly completely circling said shoulder and said drive sprocket with the inner surface of said roller chain in contact with said shoulder whereby said spinner mandrel can rotate independently of said multistrand roller chain;

(h) an idler sprocket in said chamber slidably mounted in said frame exteriorly of and in engagement with the outer surface of said multistrand roller chain and laterally movable in respect of the normal path of travel thereof;

(i) fluidly actuable clutch means mounted in said chamber in lateral engagement with said idler sprocket, said clutch means comprises:

(aa) a hydraulic piston in said chamber pivotally mounted to said frame and hydraulically interconnected with said control means;

(bb) a reciprocable piston rod mounted in said hydraulic piston for movement into and out of said piston in response to corresponding actuation of said piston by said control means and (cc) linkage means interconnecting said piston rod with said idler sprocket for moving said idler sprocket in response to movement of said piston rod and including;

(dd) adjusting means for regulating lateral movement of said idler sprocket and, hence, the magnitude of tensioning and slackening of said multistrand roller chain;

(j) fluidly actuable control means interconnected with said motor, said idler sprocket and said clutch means to simultaneously energize said motor, to control the direction of rotation of said drive sprocket and to actuate said clutch means to move said idler sprocket laterally relative to the path of travel of said multistrand roller chain to decrease the slack in said multistrand roller chain sufficiently to force said inner surface of said multistrand roller chain into frictional driving engagement with said shoulder whereby rotation of said multistrand roller chain by said drive sprocket will rotate said spinner mandrel.

3. In a well drilling rig having a derrick, a drilling platform containing a power driven rotary for supporting and rotating a string of drill pipe extending therethrough into a well below said derrick and said drilling platform, a swivel supported by said derrick above said drilling platform, a spinner mandrel threaded to and rotatably supported by said swivel and a kelley threaded to said spinner mandrel for releasably connecting said kelly to said string of drill pipe, an improved jawless kelley spinner for rotating said spinner mandrel independently of said rotary comprising:

(a) a chambered kelley spinner frame mounted about said spinner mandrel adjacent to said swivel; said frame having:

(aa) top and bottom thrust bearings are mounted on said chambered kelly frame in top and bottom openings of said chambered kelly frame, respectively, and wherein:

(bb) said spinner mandrel extends through said chamber and is mounted in said top and bottom bearings, said spinner mandrel having a box threaded portion extending above said frame, a pin threaded portion extending below said frame and a shouldered portion in said chamber;

(b) fluidly powered drive means in said chamber rotatably mounted to said frame;

(c) a fluidly powered motor carried by said frame and mechanically coupled with said drive means to fluidly power the same;

(d) a multistrand roller chain mounted in said chamber for normally slackly completely encircling said spinner mandrel and said drive means whereby said spinner mandrel can rotate independently of said multistrand roller chain; and (e) tensioning means slidably mounted in said chamber exteriorly of said multistrand roller chain in engagement with the outer surface of said flexible multistrand roller chain and movable laterally with respect to the path of travel of said multistrand roller chain for tensioning the same, said tensioning means including:

(aa) a fluidly powered piston pivotally mounted in said chamber and fluidly connected with said drive means, and (bb) a piston rod in said piston in levered connection with said tensioning means for levered engagement with said tensioning means for increasing the tension on said multistrand roller chain on levered movement of said tensioning means in response to extension of said piston rod; and (f) fluidly powered clutch means mounted in said chamber exteriorly of said multistrand roller chain for simultaneous shifting engagement with the outer surface of said multistrand roller chain to decrease the slack in said multistrand roller chain sufficiently to force the inner surface of said multistrand roller chain into frictional driving engagement with said spinner mandrel and to rotate said drive means in a predetermined direction to thereby spin said spinner mandrel in said direction; said clutch means comprising a slide frame slidably mounted in said chamber exteriorly of said multistrand roller chain for movement lateral to the path of travel of said multistrand chain, an idler sprocket rotatably mounted on said slide frame in rotational contact with the exterior surface of said multistrand roller chain, and a pivot bar assembly interconnecting said piston rod with said idler sprocket to provide for said levered movement in response to extension of said piston rod.

4. In a well drilling rig having a derrick, a drilling platform containing a power driven rotary for supporting and rotating a string of drill pipe extending therethrough into a well below said derrick and said drilling platform, a swivel supported by said derrick above said drilling platform, a spinner mandrel threaded to and rotatably supported by said swivel and a kelley threaded to said spinner mandrel for releasably connecting said kelly to said string of drill pipe, an improved jawless kelley spinner for rotating said spinner mandrel independently of said rotary comprising:

(a) a chambered kelley spinner frame mounted about said spinner mandrel adjacent to said swivel;

(aa) said chambered kelley spinner frame being provided with aligned openings in the top and bottom thereof, thrust bearings being mounted in each of said openings and said spinner mandrel extends through said openings and is mounted in said thrust bearings;

(b) fluidly powered drive means in said chamber rotatably mounted to said frame;

(aa) said fluid powered drive means including a fluidly powered motor mounted on said frame and a drive sprocket rotatably mounted in said chamber and mechanically interconnected with said motor;

(c) a single multistrand roller chain mounted on said chamber in rotatable engagement with said drive sprocket for normally slackly completely encircling said spinner mandrel and said drive means whereby said spinner mandrel can rotate independently of said multistrand roller chain;

(d) fluidly powered clutch means mounted in said chamber exteriorly of said multistrand roller chain for simultaneous shifting engagement with the outer surface of said multistrand roller chain to decrease the slack in said multistrand roller chain sufficiently to force the inner surface of said multistrand roller chain into frictional driving engagement with said spinner mandrel and to rotate said drive means in a predetermined direction to thereby spin said spinner mandrel in said direction, said clutch means including:

(aa) a slide frame assembly slidably mounted in said chamber for movement normal to the eliptical path of said roller chain, (bb) a fluidly powered piston pivotally mounted in said chamber;

(cc) a piston rod extending from said piston;

(dd) a hub rotatably mounted on said slide bar assembly;

(ee) an idler gear rotatably mounted on said slide bar assembly in engagement with the outer surface of said multistrand chain;

(ff) a lever arm assembly pivotally mounted at one end thereof on said hub and pivotally connected at the other end thereof with the free end of said piston rod, and (gg) fluidly actuable control means in fluid connection with said motor and piston to simultaneously energize said motor to rotate in a predetermined direction and to extend said piston rod so as to pivot said lever arm to thereby shift said idler gear into a roller chain tension-increasing position to thereby decrease the slack in said roller chain sufficient to bring the inner surface of said roller chain into frictional driving engagement with said spinner mandrel to rotate said spinner mandrel in said predetermined direction.

* * * * *